United States Patent [19]

Looker

[11] Patent Number: 4,979,656

[45] Date of Patent: Dec. 25, 1990

[54] DISPOSABLE CONTAINER/DISPENSER FOR RTV SILICON RUBBER PRODUCTS

[76] Inventor: Olin Looker, 116 W. Jones, Milford, Ill. 60953

[21] Appl. No.: 327,754

[22] Filed: Mar. 23, 1989

[51] Int. Cl.[5] ..... B65D 47/10

[52] U.S. Cl. ..... 222/541; 222/107; 222/206; 229/5.8

[58] Field of Search ..... 222/92, 107, 206, 212, 222/215, 541; 229/4.5, 5.5, 5.8; 206/575, 582

[56] References Cited

U.S. PATENT DOCUMENTS

| | | | |
|---|---|---|---|
| 575,206 | 1/1897 | Britton . | |
| 1,996,203 | 7/1931 | Hollingsworth | 99/16 |
| 2,102,920 | 12/1937 | Savage | 99/138 |
| 2,349,962 | 5/1944 | Harris | 222/541 |
| 2,430,995 | 11/1947 | Roos | 222/541 |
| 2,584,095 | 1/1952 | Slaughter | 229/5.8 |
| 4,708,897 | 11/1987 | Douchy | 428/36 |
| 4,878,599 | 11/1989 | Greenway | 222/1 |

*Primary Examiner*—Andres Kashnikow
*Assistant Examiner*—W. Todd Waffner
*Attorney, Agent, or Firm*—Roberts and Quiogue

[57] ABSTRACT

A container and dispenser for adhesives and sealants such as silicon rubber is disclosed. The device comprises a thin-walled tubular member formed of plastic or other material which is non-permeable to air or water vapor. The tubular member has a typical diameter in the range of $\frac{1}{8}$ to $\frac{1}{2}$ inch. The tubular member is open at each end thereof. The portion of the sealant adjacent each open cures from its exposure to the air, forming a seal or plug at each end of the tubular member. The sealant or adhesive is dispensed by cutting open the tubular member in the area intermediate the sealed ends, and squeezing the tubular member. Any unused portion will seal itself for later use.

16 Claims, 1 Drawing Sheet

10
2
2

10
14
16
20
12

14
24

14
26

22

DISPOSABLE CONTAINER/DISPENSER FOR RTV SILICON RUBBER PRODUCTS

BACKGROUND OF THE INVENTION

The present invention relates to the field of containers and dispensers, and more particularly to an inexpensive container/dispenser for adhesives, sealants, and the like, which cure by exposure to the atmosphere or water vapor, such as RTV silicon rubber products.

Silicone polymers are in wide use today in a variety of industrial and home applications. These silicons typically can be formulated to vulcanize at room temperatures (RTV). One common type of silicon rubber cures with moisture from the air. See, e.g., "Plastics Chemistry and Technology," Walter E. Davis, Litton Educational Publishing, Inc., 1979, Chapter 6, pages 74–86, incorporated herein by this reference.

RTV silicon rubber products are typically packaged for household use in squeeze tubes having a dispenser nozzle, on which is fitted a dispenser cap. Since these adhesives cure by exposure to moisture from the air, the dispensers must be sealed against air and water vapor. The nozzle tip is sealed at the factory, and the user typically forces an opening in the nozzle by a pin or other pointed object. After squeezing out the desired amount of the adhesive, the tube is resealed by the cap. Typically, however, the adhesive filling the nozzle may cure even after the cap is replaced, making it more difficult to later reopen the nozzle opening to release additional sealant.

There are many applications which require only a small portion of adhesive or sealant, for example, assembling a product provided in kit form. Many household applications for silicon rubber sealants also require only a small portion of the sealant. Many manufacturers would prefer to include all the necessary materials to assemble or finish the product with the product kit, so that the customer need not make a separate purchase of items required for assembly, including sealants. Yet it would be expensive and/or wasteful to include a conventional squeeze tube containing the sealant due to the expense of the container and because most containers hold far more sealant than required for the job at hand.

Use of small conventional squeeze tube containers for packaging small quantities of silicon rubber sealant is understood to have met with problems of moisture leakage; the integrity of some small tubes is understood to have been poor enough that the entire contents of the tube have cured due to moisture leakage into the container.

SUMMARY OF THE INVENTION

It would therefore be an advantage to provide an inexpensive container and dispenser for products such as RTV silicon rubber products, which would contain only relatively small portions of the product.

These and other objects and advantages are provided in a container and dispenser device comprising an elongated thin-walled tubular member formed of a material which is impervious to air or water vapor. The tubular member in one preferred form has a circular cross-section, a diameter in the range of ⅛th to ½inch, a length in the range of 1½ to 10 inches and is formed of a plastic material. The tubular member is filled with the product, such as RTV silicon rubber, which has the property of assuming a liquid state until exposed to the atmosphere or water vapor, which causes the exposed portion of the material to set or cure to a solid state. The product material adjacent each open end of the tubular member cures with the exposure to the atmosphere or water vapor, thereby forming a plug of the vulcanized product in place at each end of the tubular member and which is not permeable to air or water vapor. The container thus formed is substantially non-permeable to air or water vapor, and will serve to store the product in its liquid state for a substantial shelf life. The product may be dispensed from the container by cutting the tubular member open at an area intermediate the plugged ends thereof.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figures 1, 2, 3, 4, 5:
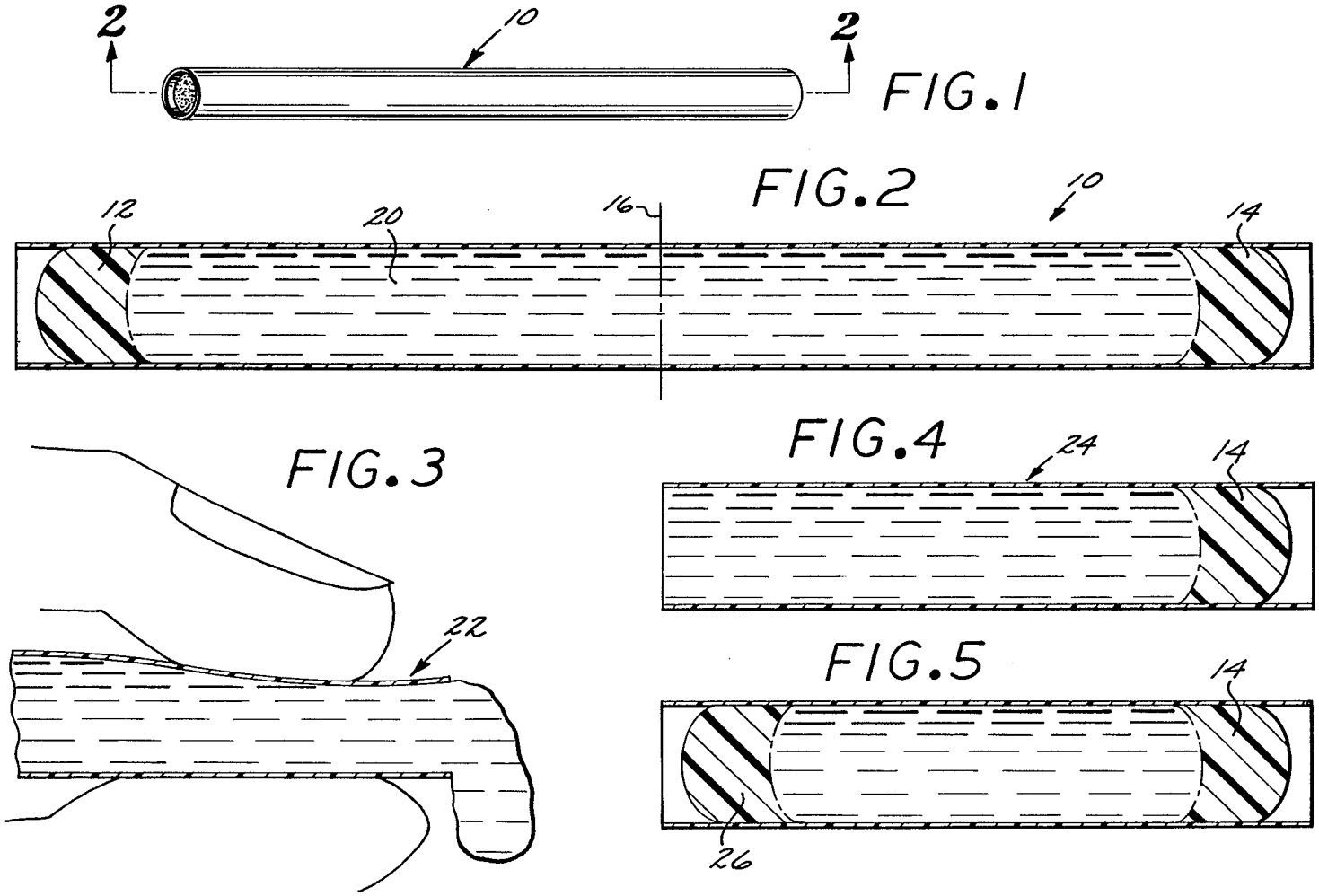
FIG. 1 is a perspective view of a sealant container and dispenser embodying the invention.
FIG. 2 is a cross-sectional view of the container arrangement of FIG. 1, taken along line 2—2 of FIG. 1.
FIG. 3 is a schematic illustration of the dispensing of the product from the container of FIG. 1, after cutting the container in the region intermediate the ends.
FIGS. 4 and 5 illustrate an unused portion of the container of FIG. 1 and its self-sealing characteristic.

The sealant container and dispenser in accordance with the invention comprises a thin-walled tubular member of a material which is non-permeable to air or water vapor. The tube may preferably have a circular cross section, with a diameter in the range of ⅛ to ½ inch. Such a container is shown in FIG. 1 as device 10. The tube length in a final form of the container is preferably in the range of 1½ to 10 inches long, the length being a function of the particular application and the amount of sealant required. Obviously the longer the container, the larger the volume of sealant which fills the container 10.

A preferable material for the tube is plastic such as low and high density polyethylenes, with a sufficient thickness as to be substantially non-permeable to water vapor, e.g., on the order of 0.020 inches. Such materials may be extruded by conventional equipment to form a hollow tube. Such equipment is commonly used to fabricate plastic disposable drinking straws, and in fact such straws may be suitable for use as the tubular member 10 if the straw is non-permeable to water vapor. Other materials may be used as well, e.g., an acrylic or a metal such as aluminum. The material should preferably be relatively inexpensive, and have the property of being non-permeable to air and water vapor, when the tube is used as a container for a product which cures on contact with air or water vapor. Moreover, the material for the tubular member preferably should permit collapsing of the tube by squeezing it to dispense the product.

The tubular member 10 is filled with the product 20 in a liquid state, such as, for example, RTV silicon rubber from one end thereof. An exemplary procedure is to use a conical fill nozzle on a bulk container of the product, the fill nozzle having a small enough diameter so that the tip of the fill nozzle can be inserted into one end of the tubular member, so that the nozzle fits tightly against the wall of the tubular member. The liquid product is released through the nozzle under pressure, forcing a column of the product into the tubular member to fill it with the product. The filling procedure is stopped just before the column of the liquid silicon rubber reaches the other end of the tubular member. The product in its liquid state is sufficiently viscous that it does not flow or drip out of the ends of the tube. The product sets or cures to a solid state at each end thereof which is open to the atmosphere, forming its own seal or plug, shown in FIG. 2 as plugs 12 and 14. The depth of the plug will be dependent on the formulation of the product. For 100% RTV silicon rubber, the plugs have been found to form to a length of about ⅜' to ¾'. The plugs 12 and 14 tightly seal the remainder of the product 20 in the tubular member 10 from exposure to the atmosphere or water vapor.

The ends of the container, after filling, may be capped, e.g., for asthetic reasons, or even heat sealed, although the primary sealing of the container at its ends in accordance with this invention is provided by plugs formed at the ends of the tubular member. Additionally, the invention may be used to provide a backup seal, in the event end caps or heat sealing of the container ends are employed. If the end caps or heat sealed joints did fail, admitting water vapor into the container, the product would cure adjacent the tube ends to thereby seal the remainder of the product.

The container and dispenser thus formed is very inexpensive and is well suited for household use or use with products shipped to a customer requiring final assembly using a small quantity of the product.

To dispense the product, the tubular member 10 may be cut open by a knife or scissors in the intermediate area between the end plugs, e.g., along line 16 of FIG. 2. A cut portion 22 of the container may be squeezed with the fingers to dispense the product 20 from the cut end, as illustrated in FIG. 3. The cut end of a non-used portion 24 of the tubular member 10 will seal itself since a new plug 26 will form, allowing the remainder of the product to be used at a later time (FIGS. 4 and 5). The spent container portion is discarded.

A tubular member having an inner diameter in the range of ⅛ to ½ inches provides a container with a reasonable amount of sealant per lineal unit dimension, which may be readily filled, and which does not provide prohibitive product losses resulting from curing at the container ends. Product loss due to this effect becomes substantial as the diameter increases substantially over ½ inches.

While the container is described with respect to RTV silicon rubber products, it is not limited to use as a container for such products. The invention may be used as a container and dispenser for any product which has assumed a liquid state when in an uncured form, and upon exposure to the atmosphere sets or cures to a solid state.

It is understood that the above-described embodiment is merely illustrative of the possible specific embodiments which may represent principles of the present invention. Other arrangements may readily be devised in accordance with these principles by those skilled in the art without departing from the scope of the invention.

What is claimed is:

1. A container for a product, the product characterized in that it assumes a liquid state until exposure to the atmosphere or water vapor, and cures to a substantially solid state upon exposure to the atmosphere, the container comprising:

a hollow elongated tubular member comprising a material which is not permeable to air or water vapor, said tubular member defining an elongated container region into which said product may be received; and a plug of the cured product in the tubular member adjacent each end thereof, said plugs being formed after said container region of tubular member is substantially filled with said product in a liquid state, wherein the portion of the product adjacent each end of the tubular member cures with exposure to the atmosphere or water vapor forms said plugs and thereby seals the remainder of the product from exposure to the atmosphere or water vapor.

2. The container of claim 1 wherein said product comprises an RTV silicon rubber product.

3. The container of claim 1 wherein said tubular member has a substantially circular cross-section of equal diameter along its extent and comprises a plastic material.

4. The container of claim 3 wherein said tubular member has a diameter in the range between about ⅛ and ½ inch.

5. The container of claim 4 wherein said tubular member has a length in the range of about 1½ inches to 10 inches.

6. A container for a product, the product characterized in that it assumes a liquid state until exposure to the atmosphere or water vapor, and cures to a substantially solid state upon exposure to the atmosphere, the container comprising:

an elongated tubular member comprising a material which is not permeable to air or water vapor, said tubular member being open at each end thereof;

said tubular member being filled with said product in a liquid state, wherein the portion of the product adjacent each open end of the tubular member cures with th4e exposure to the atmosphere at each open end of the tubular member to seal the remainder of the product from exposure to the atmosphere thereby forming a plug of the cured product in place at each end of the tubular member.

7. The container of claim 6 wherein said product comprises a silicon rubber product.

8. The container of claim 6 wherein said tubular member has a circular cross-section and comprises a plastic material.

9. The container of claim 8 wherein said tubular member has a diameter in the range between about ⅛ and ½ inch.

10. The container of claim 6 wherein said tubular member has a length in the range of about 1½ inches to 10 inches.

11. A container for an RTV silicon rubber polymer product, the product characterized in that it assumes a liquid state until exposure to the air to cure to a substantially solid state, the container comprising:

an elongated tubular member having first and second ends, said member having a diameter in the range between about ⅛ and ½inches and length in the range of about 1⅛ inches to about 10 inches, said member being open at each end thereof and comprising a plastic material which is not permeable to air or moisture;

said tubular member being filled with said silicon rubber polymer product in a liquid state, wherein a portion of the product adjacent each end of the tubular member cures with exposure to the moisture in the air to form a plug of the cured product in place at each end of the tubular member, thereby sealing the remainder of the product from exposure to the moisture in the air.

12. A method for storing and dispensing a product which assumes a liquid state until exposure to the atmosphere or water vapor, and which thereafter cures to a substantially solid state, comprising the following steps:

dispensing a quantity of the product in its liquid state into a hollow elongated tubular member having open first and second ends, the member fabricated from a pliable material which is not permeable to air or water vapor;

allowing the product adjacent the open ends of the tubular member to cure from exposure to the atmosphere or water vapor, thereby forming hardened plugs of the cured product in place at each end of the tubular member to seal the remainder of the product in the tubular member from exposure to the atmosphere or water vapor; and when it is desired to dispense a quantity of the product from the tubular member, cutting the tubular member in the area intermediate the end plugs of cured product and squeezing the tubular member to dispense the liquid product from the cut region of the tubular member.

13. The method of claim 12 wherein said product comprises an RTV silicon rubber product.

14. The method of claim 12 wherein said tubular member has a substantially circular cross-section of equal diameter along its longitudinal extent.

15. The method of claim 12 wherein the tubular member has a diameter in the range between about $\frac{1}{8}$ and $\frac{1}{2}$ inch.

16. The method of claim 15 wherein said tubular member has a length in the range of about $1\frac{1}{2}$ inches to 10 inches.

* * * * *